US006113519A

United States Patent [19]

Goto

[11] Patent Number: 6,113,519

[45] Date of Patent: Sep. 5, 2000

[54] TREADMILL FOR WHEELCHAIR

[75] Inventor: Moriki Goto, Tokyo, Japan

[73] Assignee: Suncrea Corporation, Tokyo, Japan

[21] Appl. No.: 09/166,898

[22] Filed: Oct. 6, 1998

[30] Foreign Application Priority Data

Oct. 6, 1997 [JP] Japan ..... 9-272622
Apr. 21, 1998 [JP] Japan ..... 10-111035

[51] Int. Cl.[7] ..... A63B 22/00
[52] U.S. Cl. ..... 482/54; 482/51
[58] Field of Search ..... 482/51, 54

[56] References Cited

U.S. PATENT DOCUMENTS

| | | | |
|---|---|---|---|
| 4,911,425 | 3/1990 | Kynast et al. . | |
| 4,966,362 | 10/1990 | Ramaekers | 482/54 |
| 5,476,429 | 12/1995 | Bigelow et al. | 482/54 |
| 5,643,143 | 7/1997 | Burak et al. . | |
| 5,704,876 | 1/1998 | Baatz | 482/54 |

*Primary Examiner*—Glenn E. Richman
*Attorney, Agent, or Firm*—Wenderoth, Lind & Ponack, L.L.P.

[57] ABSTRACT

A treadmill includes a braking device incorporated in the body of the treadmill and operated for applying a resistance or load against the rotary motion of treadmill rollers on which a wheelchair's side wheels are supported. The angle of inclination of the treadmill rollers may be adjusted according to any variation in the angle of inclination for the wheelchair wheels supported by the treadmill rollers. To this end, the user of the wheelchair can adjust the angle of inclination for the treadmill rollers. A guide member for supporting the front wheel of the wheelchair may also be included, and the guide member can be adjusted to accommodate practically all types and sizes of the wheelchair. A central control panel is provided at a particular single point on the treadmill for enabling the user of the wheelchair to control the braking device, adjust the angle of inclination, and moving the guide member.

12 Claims, 11 Drawing Sheets

TREADMILL FOR WHEELCHAIR

BACKGROUND OF THE INVENTION

1. Field of the Invention

The present invention relates to a treadmill for wheelchairs that is designed to help a person or occupant on a wheelchair learn how to operate the side wheels on the wheelchair, to permit the person on the wheelchair to practice physical muscular training and other like exercise motions, and to practice rehabilitating exercises and the like. More particularly, the present invention relates to a treadmill for wheelchairs that is designed to permit a person or occupant on a wheelchair to adjust the mechanical resistance or load to be applied against the rotary motion of the treadmill rollers on which the wheelchair's side wheels are supported, to permit him or her on the wheelchair to adjust the angle of inclination of the treadmill rollers according to any variation in the angle of inclination for the wheelchair wheels, and to permit the wheelchair to be supported on the treadmill with safety, reliability and stability during training and other exercises on the wheelchair. Thus, the treadmill for wheelchairs provided by the present invention allows the user of the wheelchair to practice training and do other exercises on the treadmill while staying on the wheelchair without having to move his or her wheelchair to another location in the room.

2. Description of the Prior Art

A conventional indoor exercising platform on which a person or occupant on a wheelchair can practice training or do other exercise is known which provides variable mechanical resistance or load to be applied against the rotary motion of the treadmill rollers on which the wheelchair's side wheels are supported (Japanese patent application as now published for public inspection under unexamined publication No. 7-255383). Another conventional so-called trainer for wheelchairs is also known which includes a separate device that provides a load to be selectively applied against the rotary motion of the sets of rollers on either side on which the wheelchair's wheels are supported, thereby allowing the user on the wheelchair to operate either of the side wheels for training with stability (Japanese patent application as now published for public inspection under unexamined publication No. 7-299095).

The exercising platform as firstly mentioned above may allow for the adjustment of the resistance or load to be applied against the rotary motion of the rollers on which the wheelchair wheels are supported, but it has several problems yet to be solved. For example, when the load to be applied against the rotary motion of the rollers is provided by friction, the inertial force may be lost. For the trainer including the separate device for providing the load to be applied against the rotary motion of the rollers, as secondly mentioned above, the device must be provided as an external device, which requires extra floor space and which also complicates the mechanical construction.

Specifically, the problems associated with the exercising platform that remain yet to be solved include making the wheelchair wheels unstable on the rollers during the actual training exercise, making it difficult or impossible to adjust the angle between the roller shaft on the platform and the wheel shaft on the wheelchair, and making it difficult to guide the wheelchair wheels onto the platform. More specifically, if it is difficult or impossible to adjust the angle of inclination of the roller shaft with regard to the wheel shaft when the latter is inclined during the training exercise, and thus the wheelchair becomes unstable, and its side wheels might slip out of the rollers.

Furthermore, the exercising platform has another problem yet to be solved in that there is no means for controlling the means for adjusting the resistance or load to be applied against the rotary motion of the rollers.

The trainer which permits the user of the wheelchair to conduct the training exercise by operating either of the side wheels has some problems yet to be solved, with particular regard to the stability of the wheelchair wheels on the treadmill rollers and the ease of controlling the various adjusting means.

SUMMARY OF THE INVENTION

Accordingly, the present invention solves the problems mentioned above, and proposes to provide a novel, easy-to-use treadmill that may be used with all types and sizes of wheelchairs. According to the present invention, the treadmill includes means that permits the user of the wheelchair to adjust the inclination angle of a treadmill roller shaft according to the inclination of wheelchair wheels supported by the treadmill roller, thereby ensuring that the wheelchair wheels can be supported on the treadmill rollers with stability. That is, the angle of inclination of the rollers may be adjusted according to any variation in the angle of inclination of the wheels. Furthermore, the treadmill according to the present invention includes guide members for the side wheels on the wheelchair that may be moved closer to or away from the body of the treadmill formed by a platform, and means for adjusting the distance between the guide members. Thus, the treadmill may be used with various types and sizes of wheelchairs. The treadmill according to the present invention further includes two sets of rollers arranged in parallel for supporting the side wheels on the wheelchair, means for adjusting the load or resistance to be applied against the rotary motion of those rollers, and means for adjusting the angle of inclination of the rollers in response to any change in the angle of inclination in the side wheels, all of which are housed inside the platform body of the treadmill. For ease of operation, a single central control panel is provided for enabling the user of the wheelchair to control the means for adjusting the load or resistance applied to the rotation of rollers, the means for adjusting the angle of inclination of rollers, and other functional units at a single center point on the treadmill.

Specifically, the present invention provides a treadmill that permits the user of the wheelchair to control the resistance to be applied against the rotary motion of the rollers on which the wheelchair side wheels are supported, wherein it includes a casing which forms the body of the treadmill, two sets of rollers disposed in the casing, each set having two parallel rollers, means for adjusting the angle of inclination of the rollers disposed in the casing, means for adjusting the resistance to be applied against the rotary motion of the rollers disposed in the casing and operatively coupled with the two sets of rollers, an auxiliary casing adapted to be connected to one side of the casing for advancing the wheelchair onto the treadmill, a guide casing adapted to be connected to the other side of the casing and including guide members for the wheelchair, and a single central control panel for enabling the user of the wheelchair to control the operation of all of the functional units listed above at a single control point on the treadmill.

More specifically, the two sets of rollers are mounted in two sets of roller support frames, respectively, which are mounted swingably and pivotally in the casing. To permit this swinging and pivotal motion, shafts or rods which act as a fulcrum for the respective roller support frames are provided on the opposite center sides (inner sides) of the casing, extending transversely of the roller support frames through the casing. The means for adjusting the angle of inclination of the rollers includes means for tilting each of the roller support frames swingably and pivotally about the respective shaft or rod.

The means for applying the resistance or load against the rotary motion of the rollers includes a resistor device having its output shaft connected to at least one of the rollers in each set and which may be operated by any electrical or mechanical means to vary the rotary motion of the said output shaft.

The wheel guide means includes two guide members extending vertically from the guide casing, each of which is adapted to engage the front side of the corresponding side wheel. The distance between the guide members may be adjusted, and the guide casing may be moved closer to and away from the treadmill casing body.

As described above, the treadmill is divided into three separate units, such as the casing body, the auxiliary casing and guide casing, that may be combined to form the treadmill. As a variation of the treadmill, it may have the construction that incorporates those functions into a single unit. It is important to note that the treadmill may have any form and construction, provided that it ensures the ease with which the wheelchair can be lifted up and down, the stability with which the wheelchair can be maintained during training and other exercises, and the safety with which the training and other exercises can be practiced, and provided that the treadmill includes a control unit that enables the user to control the operation of the functional units at a single control point, such as the means for adjusting the angle of inclination of the rollers, the means for applying the resistance or load against the rotary motion of the rollers, and the means for guiding the wheelchair side wheels.

The control functions provided by the control unit may be implemented by a control panel which contains control lines and a power line. The control panel may be located on the casing body, and may have switches and buttons. The switches or buttons may be ON or OFF, delivering the appropriate control signals or instructions through the control lines to the appropriate functional units. The current output state may be displayed on the control panel, and may be adjusted by using the appropriate switch or button.

The values of the various parameters, such as the resistance or load being applied against the rotary motion of the rollers, the number of rotations of the rollers, the traveling distance of the wheelchair corresponding to the number of rotations of the rollers, the traveling speed of the wheelchair, and other current status of each functional unit, may be displayed on the control panel in a digital or analog form. This may help the user check the effect of the current training, and determine how much and how strongly the daily training should be practiced, depending upon the particular physical power of each user.

The total weight supported by the two sets of rollers may be displayed on the control panel. This may help the user check the current load weight and traveling speed.

Another embodiment of the treadmill for the wheelchair as proposed by the present invention includes means for controlling the resistance or load to be applied against the rollers, wherein it further includes the body of the treadmill formed by a platform, sets of parallel rollers for supporting the side wheels on the wheelchair and arranged within the platform in positions corresponding to those of the side wheels, means disposed within the platform for pivotally tilting the rollers, braking means disposed within the platform for applying resistance against the rotary motion of the rollers, and display means disposed on the platform for presenting the operational status of the treadmill.

In this embodiment, the rollers are mounted in two sets of roller support frames, respectively. Those roller support frames are mounted on the platform so as to permit them to swing pivotally about two respective support rods which extend transversely of the corresponding roller support frames on opposite central sides. The means for tilting the rollers vertically and pivotally may be configured to permit the other sides of the roller support frames opposite the central sides to engage the corresponding lateral walls of the platform at a height that may be adjustable.

The configuration that permits the other side of the roller support frame to engage the lateral wall of the platform may include a series of steps provided on the other side of the roller support frame and a rod mounted on the lateral wall of the platform for disengageably engaging any one of the series of steps.

The roller support frames may be mounted attachably, removably or reorientably in the platform.

The braking means may have two different configurations, which are described below. The first configuration may include a flywheel, a shaft in parallel with the roller shaft for supporting the flywheel, a timing pulley fixed to each of the roller shaft and flywheel shaft, a timing belt threaded around each of the timing pulleys, a load belt threaded around the flywheel, and means for adjusting the pressure of contact of the load belt against the outer periphery of the flywheel. Alternatively, the second configuration may include a flywheel, a shaft in parallel with the roller shaft for supporting the flywheel, a timing pulley fixed to each of the roller shaft and flywheel shaft, a timing belt threaded around each of the timing pulleys, a load belt threaded around the flywheel, and means for adjusting the tension of the load belt around the outer periphery of the flywheel.

In either of the above configurations, the timing pulleys are fixed to the roller shaft and flywheel shaft, respectively, and the common timing belt is threaded around both timing pulleys. Accordingly, the rotary force applied from the wheelchair wheels to the rollers may be transmitted to the flywheel via the timing belt, where the rotary energy may be stored temporarily, which may then be transmitted to the rollers as a counter force that can make the wheels roll smoothly on the rollers. The load belt engaging the flywheel can accurately transmit the increase or decrease of load to the rollers via the flywheel, the timing belt, and then the timing pulleys.

The load may be controlled by adjusting the pressure of contact of the load belt against the outer periphery of the flywheel. That is to say, the load may be controlled by adjusting either the pulling force applied to the load belt or the tension of the load belt, or both.

The preferred method of controlling the load is to adjust the tension of the load belt. In this way, stepless load control may be achieved in a simple manner.

The timing pulleys may be interchangeable. That is, different timing pulleys of different diameters may be used, depending upon differing needs. In this way, the inertial force provided by the flywheel may be varied to control the load.

The treadmill described above may further include a lift stand that is capable of moving up and down, and two engaging members for engaging the lift stand in parallel with the roller shafts on the platform, one of which may be provided on the edge on one lateral side of the platform and the other of which may be provided on the edge on the other lateral side of the platform. In this way, the lift stand may be made to engage the engaging member on the edge on the one or other lateral side of the platform when the lift stand moves up to its highest position. To permit its possible use with a sports wheelchair, the treadmill may include a support plate on the front side of the platform, which may be used to support the front wheel of the sports wheelchair. Specifically, the support plate may be mounted at its end to the edge of the front side of the platform where the lift stand may be provided. In addition to the display means described above, a stopper that engages the foot rest on the wheelchair may be provided on the platform. Specifically, the display means and the stopper may be detachably attached on the platform, and may be mounted either on the front or rear side of the platform.

According to the above arrangement, the person or occupant on the wheelchair may be moving up either on the front or rear side of the platform, where he or she may advance onto the platform for training exercises.

The two sets of roller support frames, each set containing the parallel rollers, may be interchangeable so that the user can satisfy his or her particular needs.

All of the functional units, such as the means for vertically tilting the rollers, the braking means for applying the resistance or load against the rotary motion of the rollers, and the like may be housed within the platform, except for some units, such as the display means, the control panel and the like, that must be visible to the user. It will thus be easy to install or set up the treadmill. When not in use, it will be easy to handle and store. As the lift stand may be removably mounted to the platform, it may be used as a cover for the platform when not in use.

A sensor that detects the magnitude of the load applied against the rotary motion of the rollers and a display that presents the detected output may be provided on the platform. The current values of the parameters, such as the magnitude of the load being applied against the rotary motion of the rollers, the traveled distance of the wheelchair, and the like, that have been detected by the sensor may be presented on the display. Such information may help the user to keep track of the operational conditions during the actual training exercise. Specifically, the angle of inclination of the rollers may be detected by a limit switch that senses the angle of inclination of the handle. The magnitude of the load being applied against the rotary motion of the rollers may be provided by detecting the contact pressure of the load belt upon the flywheel and the tension of the load belt.

As the rollers on which the wheelchair's side wheels are supported may be tilted according to any change in the angle of inclination of the side wheels that may occur, the wheelchair can be supported on the rollers with stability. Specifically, when the side wheels are inclined by a certain angle, the rollers may be tilted by the angle that corresponds to that angle of inclination of the wheels. Thus, the rollers and wheels may be positioned at a right angle relative to each other, and the rotary motion of the wheels may be transmitted to the rollers accurately. The action of the resistance or load produced against the rotary motion of the rollers in response to the actual rotary motion of the wheels may be imparted to the rotary motion of the wheels reliably and accurately.

The guide means for guiding the wheelchair wheels, the stopper for the foot rest on the wheelchair, and the guide frame for engaging the wheel or the front wheel on the wheelchair may be coupled with the means for tilting the rollers, so that the wheelchair can be supported with greater stability during the training exercise. Thus, the person or occupant on the wheelchair can conduct the training or other exercises with safety and with reliability.

The magnitude of the resistance or load to be applied against the rotary motion of the rollers on which the wheelchair's side wheels are supported may be varied so that the optimum load may be obtained according to the particular physical and muscular power of the user who conducts the training or other exercises.

It may be understood from the above description that the user can train with safety and with reliability, and that as the physical and muscular power of the user increases as a result of the initial training, the user may increase the physical and muscular power further by varying the magnitude of the resistance or load to be applied against the rotary motion of the rollers, and by changing the training time schedules as appropriate.

The treadmill according to the present invention is, as a rule, designed to help the person or occupant on the wheelchair practice the training exercise by himself or herself, without relying upon other persons. If the user is inexperienced, it is recommended that any qualified person (or any experienced person) help the user practice the training exercise until the user has become accustomed to using the treadmill. The treadmill according to the present invention may be used by persons of all ages and/or both sexes, and should preferably be used by setting up the training schedule according to the individual's requirements, including age, sex, experience, and other physical conditions. Those initial training schedules may be modified as the training progresses, but this should preferably be done on an individual user basis since the training progress may differ from one user to another.

BRIEF DESCRIPTION OF DRAWINGS

FIG. 3(*b*) is a side elevational view illustrating means for adjusting the angle of inclination of the rollers according to the embodiment of FIG. 1, with some non-essential parts or elements not shown;

FIG. 4(*b*) is a conceptual diagram illustrating how the wheelchair's side wheel guide means may be moved closer to or away from each other according to the embodiment of FIG. 1;

FIG. 7(*b*) is a partly enlarged view of FIG. 7(*a*);

FIG. 8(*b*) is a partly enlarged view of FIG. 8(*a*);

FIG. 9(*b*) is a partly enlarged view of FIG. 9(*a*);

DETAILS OF PREFERRED EMBODIMENTS (First Embodiment)

Figure 1:
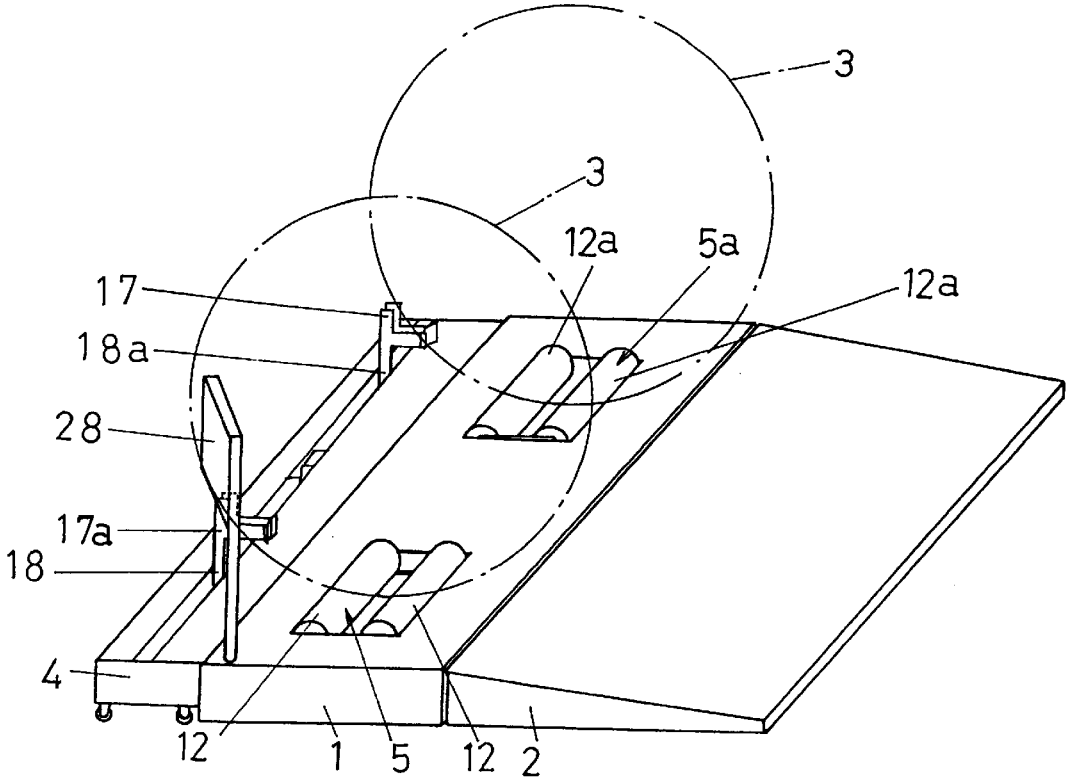
FIG. 1 is a perspective view illustrating a preferred embodiment of the present invention.
Figure 2:
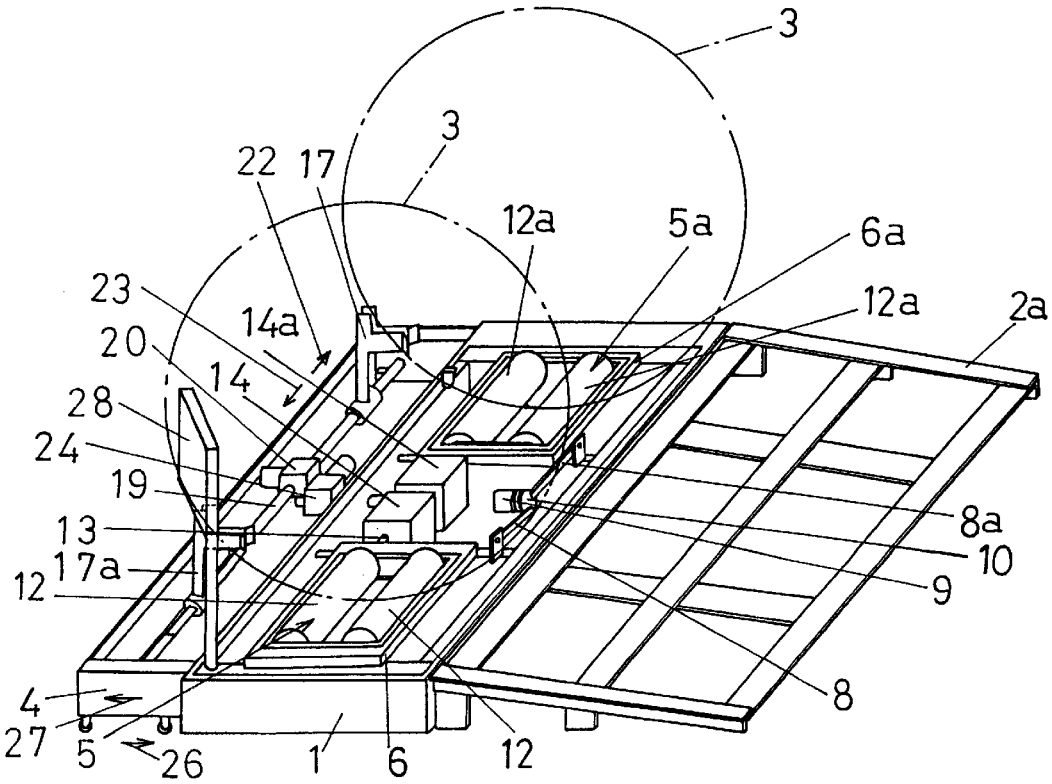
FIG. 2 is a perspective view illustrating the internal construction of the embodiment of FIG. 1, with some non-essential parts or elements not shown.
Figure 3:
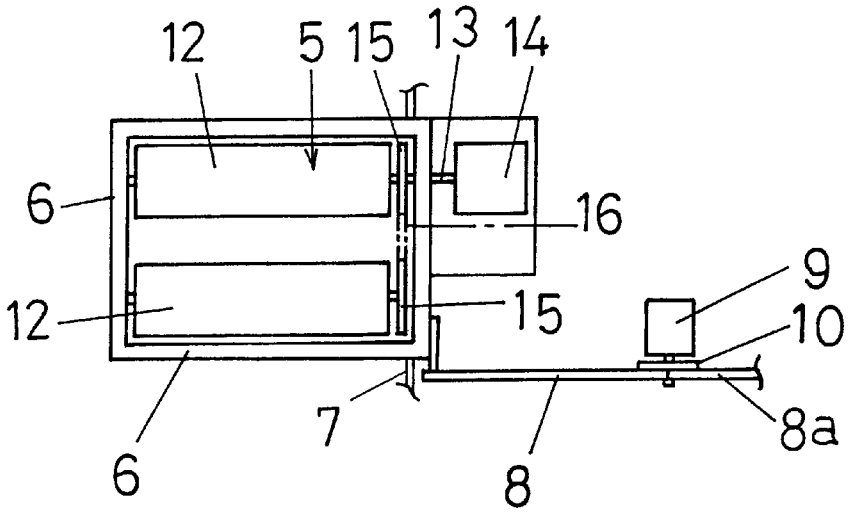
FIG. 3(*a*) is a plan view illustrating a means for adjustably providing resistance to be applied against rotary motion of rollers according to the embodiment of FIG. 1, with some non-essential parts or elements not shown.
Figure 3B:
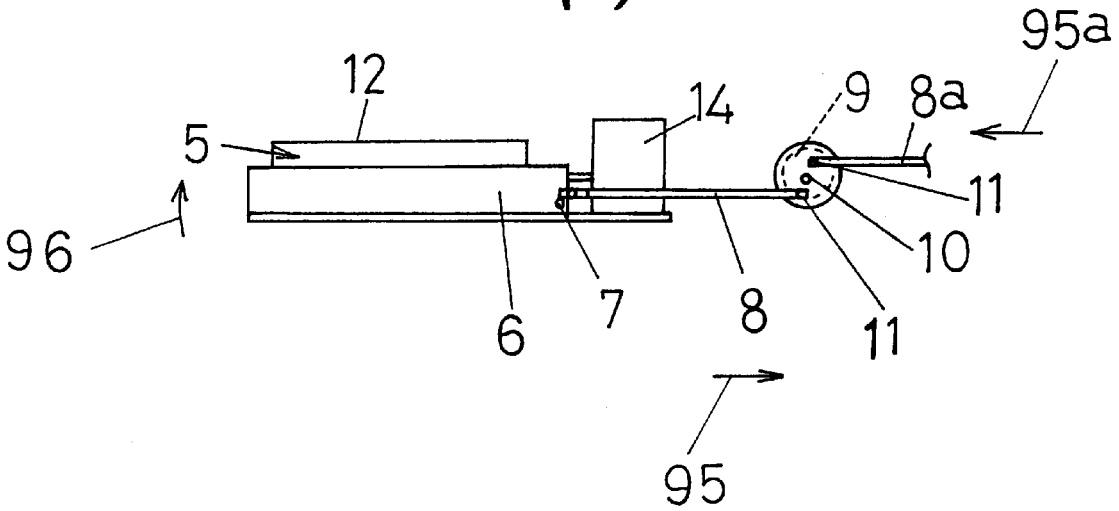

Referring to FIGS. 1, 2, 3(*a*), 3(*b*), 4(*a*), and 4(*b*), a first embodiment of the present invention is described. The treadmill for wheelchairs according to the first embodiment of the present invention includes a casing 1 forming a main body of the treadmill, an auxiliary casing 2 operatively connected to one side (rear side) of the casing 1 for advancing the wheelchair onto the treadmill, and a guide casing 4 operatively connected to the other side (front side) of the casing 1 for guiding side wheels 3, 3 on the wheelchair and being capable of movement closer to or away from the casing 1 (FIGS. 1 and 2). The auxiliary casing 2 is supported on an internal crossbar structure 2*a* as shown in FIG. 2. The casing 1 contains two sets of roller support frames 6, 6*a*, for example, which are arranged on the left and right sides of the casing 1 and in parallel with each other (FIG. 2).

The roller support frames 6, 6*a* have an identical construction, and the following description is only provided for the roller support frame 6, but may also apply to the other roller support frame 6*a*.

The casing 1 accommodates pivotal shafts 7, 7*a* on opposite center sides (inner sides) thereof which extend transversely of the casing 1 and across the roller support frames through the casing 1 (FIGS. 3(*a*), 3(*b*)). The roller support frames 6, 6*a* are so mounted on the casing 1 as to permit them to swing pivotally about the respective shafts 7, 7*a* at small angles of between 5 and 15 degrees with regard to the horizontal plane. Each of the roller support frames 6, 6*a* contains a set of two parallel rollers, generally designated by 5, 5*a*, respectively. Specifically, each set includes two parallel rollers, 12, 12 or 12*a*, 12*a*, which are mounted in the corresponding roller support frame, and the wheelchair's side wheels 3, 3 are supported on those rollers so that they can roll (FIGS. 2, 3(*a*)).

A reduction gear motor (or pulse motor) 9 is disposed at the middle point between the roller support frames 6 and 6*a* within the casing 1 (FIGS. 2, 3(*a*)). The reduction gear motor 9 has a rotating shaft to which a disk plate 10 is fixed. One end of arms 8, 8*a* is connected to the disk plate 10 eccentrically and rotatively by pins 11, 11, respectively, as shown in FIG. 3(*b*). The other end of each of the arms 8, 8*a* is rotatively connected to the center side (inner side) of the corresponding roller support frame 6, 6*a* by means of a pin (not shown) so as to cause the swinging of the roller support frame 6, 6*a* about the respective shaft 7, 7*a* (FIGS. 3(*a*), 3(*b*)) by rotation of the disk plate 10.

In operation, when the reduction gear motor (or pulse motor) 9 is started up, it causes the arms 8, 8*a* to move in the direction of arrows 95, 95*a*, respectively, which in turn causes the corresponding roller support frame 6 to swing about the pivotal shaft 7 in the direction of arrow 96 (FIG. 3(*b*)). Specifically, the roller support frame 6 may be swung through small angles (between 5 and 15 degrees) with regard to the horizontal plane. Thus, the roller 5 may be inclined by a degree corresponding to the inclination of the wheel 3 supported by the roller 5. Although not shown, it is noted that the same operation as described above for the roller support frame 6 (FIG. 3(*b*)) may be performed for the roller support frame 6*a* and the roller 5*a*, as well.

One roller 12, 12*a* of the two rollers in each set 5, 5*a* has its rotary shaft coupled to one end of a resistance shaft 13, the other end of which is coupled to an output shaft of a resistor 14, 14*a* mounted on the respective roller support frame 6, 6*a* (FIGS. 2, 3(*a*)). The rollers 12, 12 comprising the roller 5 have pulleys 15, 15 fixed to one end thereof, and a belt 16 is threaded around the pulleys 15, 15. This belt 16 may be a timing belt, for example, which synchronizes the rotation of the two rollers 12, 12, thereby causing both rollers to rotate at a constant rate (FIG. 3(*a*)). Although not shown, it is noted that the two rollers 12*a*, 12*a*, comprising roller 5*a*, may also be operated synchronously by the combination of the pulley and timing belt.

The resistor 14, 14*a* may be operated to adjust the resistance or load to be applied against the rotary motion of the roller 12, 12*a*.

In this embodiment, a guide casing 4 is provided for guiding the side wheels 3, 3 on the wheelchair. The guide casing 4 may be moved closer to or away from the casing 1 as shown by arrows 26, 27 in FIG. 2. Specifically, the guide casing 4 includes drive wheels 29, 29, rollingly mounted on the bottom thereof, which are in contact with the floor surface on which the treadmill is placed. The guide casing 4 contains a reversible motor 24 that can rotate forwardly or reversely. When the reversible motor 24 is started up, the rotation may be transmitted to gears 21, 25, where the speed is reduced, and through which the rotation may then be transmitted to the drive wheels 29, 29 (FIG. 4(*a*)). By starting and stopping the reversible motor 24 and by controlling its direction of rotation, the guide casing 4 may be moved in the direction 26 or 27 (FIG. 2). In this way, the guide casing 4 may travel closer to or away from the casing 1 as shown by arrows 26, 27 in FIG. 2.

Figure 4:
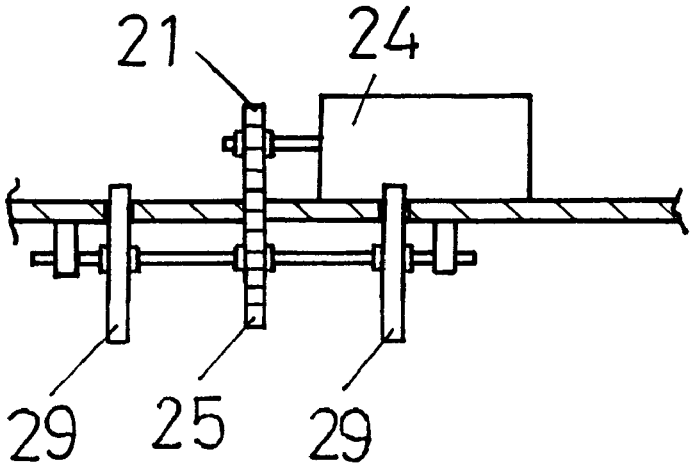
FIG. 4(*a*) is a conceptual diagram illustrating how a wheelchair's side wheel guide means may be moved closer to or away from a treadmill casing body according to the embodiment of FIG. 1.
Figure 4B:
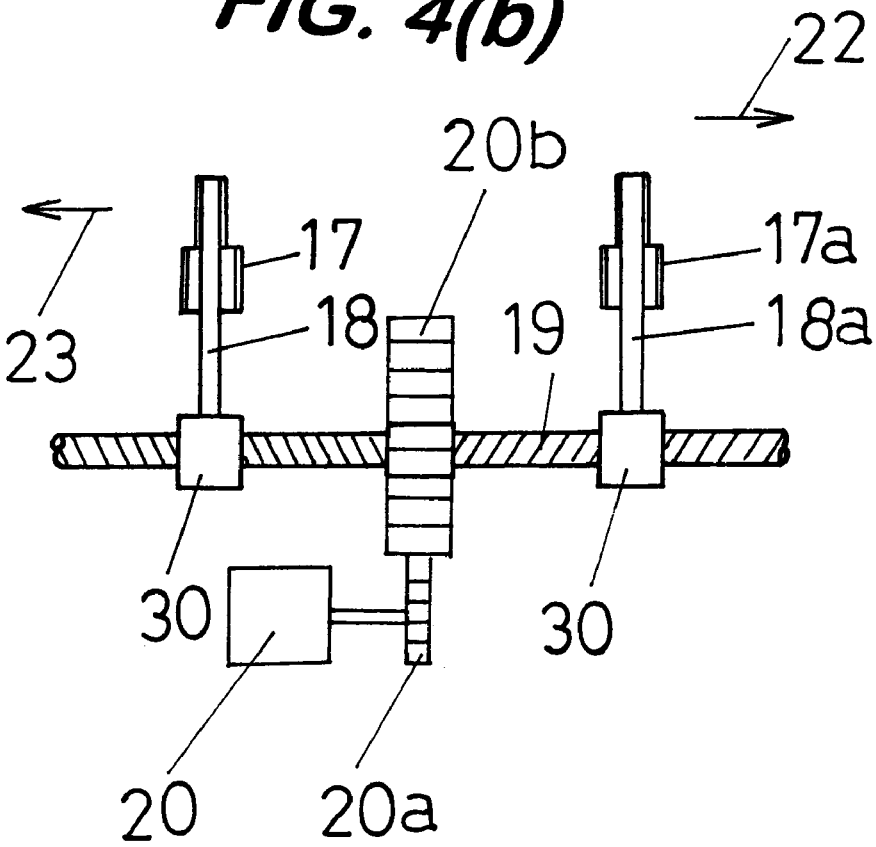

The guide casing 4 includes a pair of guide members 17, 17*a* extending vertically from the guide casing 4 and adapted to engage the corresponding side wheels 3 on the wheelchair. There are rods 18, 18*a* that support the corresponding guide members 17, 17*a*, and the rods have internally-threaded pipe sections 30, 30*a* at their lower portions, respectively, which mate with an externally-threaded rod 19 rotatably mounted across the guide casing 4 as shown in FIG. 4(*b*). The rod 19 may be driven for rotation by a motor 20 whose driving force may be transmitted to the rod 19 via gears 20*a,* 20*b*. It is noted that the portions of the rod 19 that mate with the corresponding sections 30, 30*a* have opposite threads. Thus, when the motor 20 drives the rod 19 for rotation, the rod 19 causes the support rods 18, 18*a* to move in the direction of arrows 22, 23, i.e., in the opposite direction (FIGS. 2, 4(*b*)). In this way, the distance between the guide members 17 and 17*a* may be adjusted.

As described, the guide casing 4 may be moved closer to or away from the casing 1 and the distance between the guide members 17, 17*a* may be adjusted according to the size of diameter of side wheels and width across the side wheels of a particular wheelchair. Thus, the treadmill according to the present invention may be used with all types and sizes of wheelchairs having different diameter wheels and different widths therebetween. The person or occupant on the wheelchair can conduct the training or other exercises with safety and stability as the side wheels can be supported to be in stable positions by the assistance of guide members 17, 17*a*.

All functional units such as the reduction gear motor 9, resistors 14, 14*a,* and motors 20, 24, as well as the operational parameters for them such as start and stop, the number or speed of rotation, the direction of rotation, the magnitude of the output resistance and the like, as described above, may be controlled at a single control point. For example, a control panel 28 may be provided on the front side of the casing 1. The control panel 28 may contain control lines and a power line. The control lines may be used to control the reduction gear motor 9 and other units, and the power line may be used to supply power to those units. A control instruction to any of the functional units, such as the reduction gear motor 9, may be provided on the control panel 28 to enable the appropriate functional unit to operate as instructed, such as start and stop, controlling the magnitude of the output, etc. A display panel may be provided on the control panel 28, and the display panel may present the current operational status for the functional units such as the reduction gear motor 9, etc., and the current values of the various parameters such the angle of inclination for the roller support frames, the load or resistance being applied against the rotary motion of the rollers, the number or speed of rotation of rollers, etc. This information may help the user to know the strength and amount of the current training, etc. and practice the training more effectively.

In the arrangement according to the embodiment described above, the casing 1 contains the pivotal shafts 7, 7*a,* each extending transversely of the casing 1 on the center sides thereof, and the roller support frames 6, 6*a* mounted swingably and pivotally about the corresponding pivotal shafts 7, 7*a,* each roller support frame 6, 6*a* including parallel rollers 12, 12 or 12*a,* 12*a* rotatably mounted across the roller support frame 6, 6*a*. The casing 1 includes the reduction gear motor 9 and the disk plate fixed to the shaft of the motor 9. Each of the arms 8, 8*a* has one end connected to the disk plate rotatably and eccentrically, and has the other end rotatably connected to the corresponding roller support frame 6, 6*a* on the center opposite sides thereof. The roller support frames 6, 6*a* may be swung vertically and pivotally, causing the respective rollers 12, 12 or 12*a,* 12*a* therein to be tilted.

It is noted that the tilting mechanism for the rollers 12, 12 or 12*a,* 12*a* according to the inclination of wheels 3, 3 of wheelchair is not limited to that described above. Any mechanism by which the rollers 12, 12 or 12*a,* 12*a* may be tilted at small angles of between 5 and 15 degrees with regard to the horizontal plane by raising or lowering the rollers on the left and right sides of the casing 1 about the respective center pivotal shaft 7, 7*a* transversely mounted on the center of casing, by any driving mechanism contained in the casing and controlled by a single central control unit such as control panel 28, may be used in substitution for the above described example.

Alternatively, the pivot shafts may be provided on the left and right sides of the casing 1, and the roller support frames 6, 6*a* may be operated so that they can swing pivotally about the respective pivot shaft extending transversely of the casing 1 on the left and right sides of thereof In this embodiment, the resistors 14, 14*a* are provided to apply a resistance or load against the rotary motion of the rollers 12, 12*a,* and the output of the resistors 14, 14*a* may be varied by electrical means. Alternatively, this may be accomplished by mechanical means, for example, by using plural gears, and combining them so as to change the rotating motion of the output shaft of resistors 14, 14*a*.

(Second Embodiment)

Figure 5:
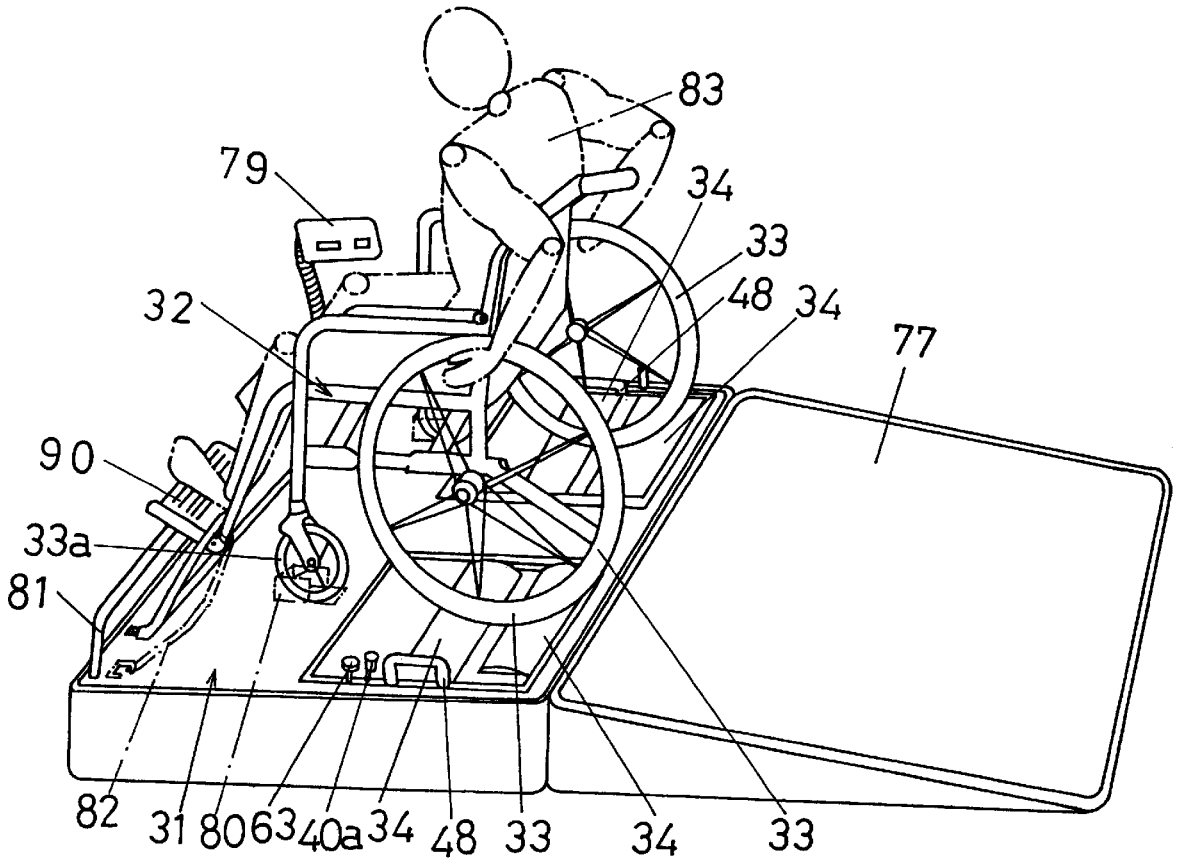
FIG. 5 is a perspective view illustrating how another preferred embodiment of the present invention may be used.
Figure 6:
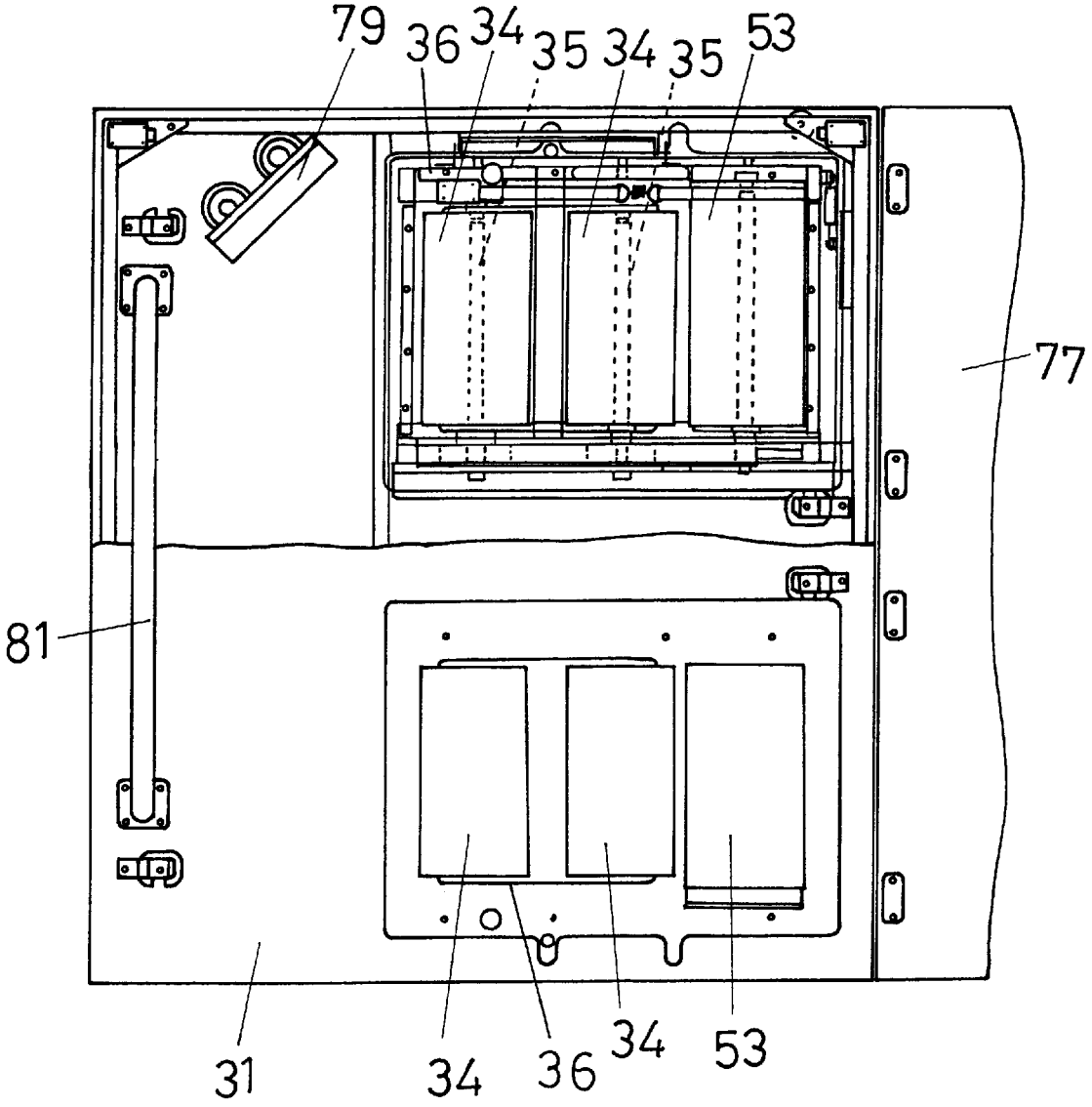
FIG. 6 is a plan view illustrating how roller support frames that are mounted to the casing body may be interchangeable according to the embodiment of FIG. 5, with some non-essential parts or elements not shown and some portions shown as broken away.
Figure 7:
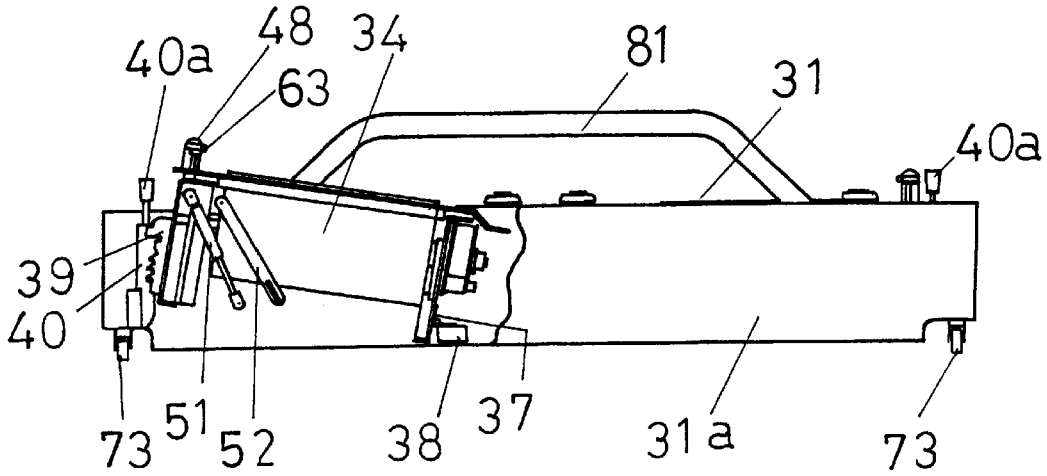
FIG. 7(*a*) is a side elevation illustrating how the roller support frames may be tilted according to the embodiment of FIG. 5, with some non-essential parts or elements not shown.
Figure 7B:
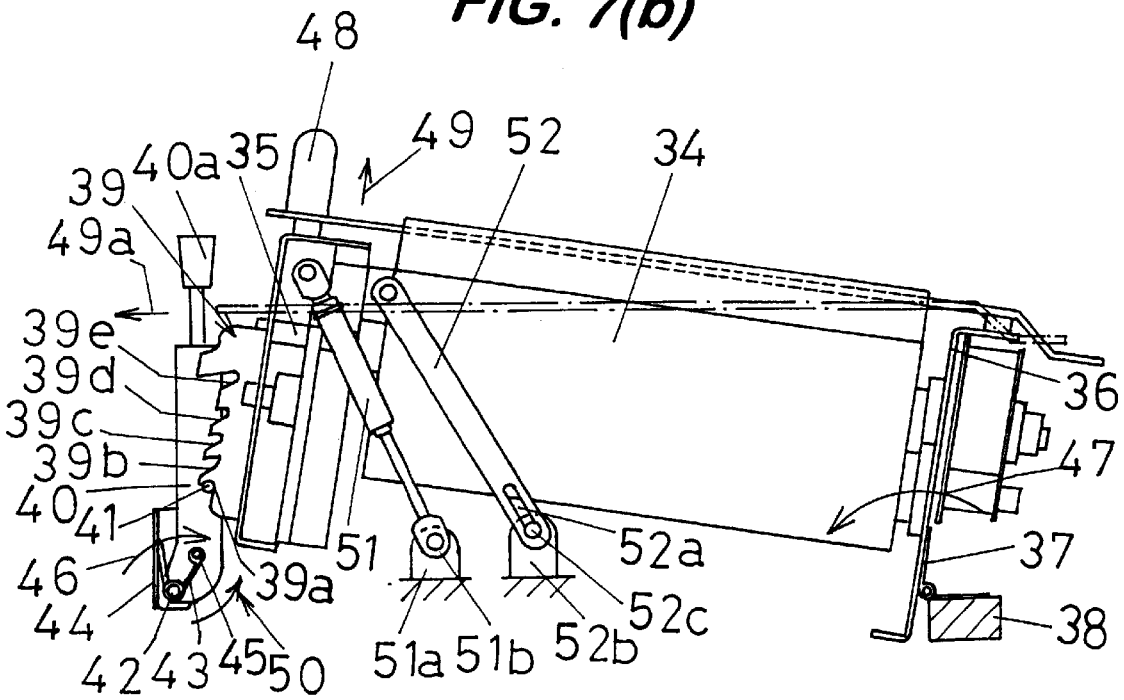

Referring next to FIGS. 5, 6, 7(*a*), 7(*b*), 8(*a*), 8(*b*), 9(*a*), 9(*b*), 10 and 11, a second embodiment of the present invention is described. The body of the treadmill formed by a rectangular platform 31 includes two sets of parallel rollers 34, 34 mounted for rotatably supporting the side wheels 33, 33 of a wheelchair 32 thereon (FIGS. 5, 6). The diameter and length of the rollers 34, 34, and the distance between the rollers may be determined depending upon the particular dimensional requirements for the wheelchair. The two sets of rollers 34, 34 have an identical construction, and the following description is only provided for one set of rollers 34, 34, which may also apply to the other set of rollers.

The rollers 34, 34 are rotatably supported on shafts 35, 35 which are mounted across a roller support frame 36, 36. One side (center side of the platform 31) of the roller support frame 36 is fixed at its bottom to a support rod 38 by way of a hinge 37, the support rod 38 extending transversely of the platform 31. As shown in FIGS. 7(*a*) and 7(*b*), the hinge 37 has its one side secured to the roller support frame 36, and has its other side secured to the support rod 38. On the side opposite the side where the roller support frame 36 is secured to the support rod 38 via the hinge 37, that is to say on the right and left sides of the platform 31, there is an engaging plate 39 that includes a series of down-directed steps 39*a,* 39*b,* 39*c,* 39*d,* 39*e* along the length of the engaging plate 39 (FIG. 7(*b*)). The steps 39*a* through 39*e* on the engaging plate 39 faces an engaging rod 41 on a release lever 40 whose bottom end is rotatably mounted to the bottom of each of the right and left sides of the platform 31. Those steps may be disengageably engaged by the engaging rod 41. The release lever 40 is fixed to a mounting shaft 42 extending transversely of the platform 31, and the mounting shaft 42 has a spring 43 mounted around it. The spring 43 has its one end secured to a pin 45 on the lever 40, and has its other end secured to a bracket 44 on the platform 31. The spring 43 is normally biased to urge the lever 40 to swing toward the engaging plate 39 as indicated by an arrow 46 (FIG. 7(*b*)). A buffer 51 and a guide rod 52 are connected rotatively at respective upper ends to the roller support frame 36. Specifically, the buffer 51 is connected rotatively by a pin 51*b* to a bracket 51*a* on the platform 31. The buffer 51 serves to permit the angle of the roller support frame 36 to be varied gently. The guide rod 52 has an elongated hole 52*a* through which a pin 52*c* fixed on the bracket 52*b* on the platform 31 may be inserted. Thus, the movement of the guide rod 52 may be guided by the pin 52*c,* and the movement of the roller support frame 36 may thus be guided for its angle to be varied.

As the roller support frame 36 is swingably mounted to the support rod 38 via the hinge 37, the roller support frame 36 is normally urged to swing in the direction of an arrow 47 by the weight of the rollers (FIG. 7(*b*)). The release lever 40 is normally urged by the spring 43 in the direction of an arrow 46, allowing any one of the steps 39*a*, etc. and the engaging rod 41 on the release lever 40 to normally engage each other. Then, when a handle 48, which is mounted to the free end of the roller support frame 36, is raised in the direction of an arrow 49, the point where the engaging plate 39 now engages the engaging rod 41 may easily be moved up and down to any desired step. As the bottom end of the roller support frame 36 on the center side thereof is fixed to the support rod 38 via the hinge 37, the angle of inclination of the roller support frame 36 becomes greater as the point of engagement is going down. For example, as shown in FIG. 7(*b*), the roller support frame 36 is inclined at an angle of 9 degrees where the point of engagement is placed at the lowest step 39*a*. Starting at the current point of engagement, it may be moved to any higher step, causing the roller support frame 36 (that is, the rollers 34, 34) to be inclined at an angle of less than 9 degrees.

When the lever handle 40*a* on the release lever 40 is pulled in the direction of an arrow 49*a*, the release lever 40 may be swung pivotally about its mounting shaft 42 in the direction of an arrow 50, causing the engaging rod 41 to be disengaged from any one of the steps 39*a*, etc. that engages the engaging rod 41. Then the roller support frame 36 will automatically be swung pivotally about the mounting shaft via the hinge 37 in the direction of an arrow 47, causing the engaging rod 41 to engage the highest step 39*e* and thus placing the roller support frame 36 in its horizontal position. In other words, pulling the lever handle 40*a* toward the arrow 49*a* causes the roller support frame 36 to be held with the roller 34 being placed in its horizontal position, and the roller 34 is then restored to the original position before its angle of inclination was adjusted. As the roller support frame 36 is being swung, the buffer 51 is activated to ensure that a gradual angle change can occur, rather than a sudden angle change. The swinging of the roller support frame 36 can occur by being guided by the combination of the elongated hole 52*a* and pin 52*c*, and any excessive swaying can thus be avoided.

The swinging of the roller support frame may be done when there is any variation in the angle of inclination for the wheelchair's side wheels. The rollers 34, 34 on which the side wheels are supported will also be inclined accordingly so as to be adjusted to the variation in the angle of inclination for the wheels. This ensures that the side wheels will not slip out of the rollers 34, 34. If the side wheels are not supported uprightly by the rollers 34, 34, the rotary motion of the side wheels might not be transmitted to the rollers 34, 34 accurately, or the resistance or load being applied against the rotary motion of the rollers 34, 34 might not be transmitted to the side wheels accurately. Such situation may also be avoided by varying the inclination angle of the roller support frame 36 (that is, the rollers 34, 34) according to the inclination of the side wheels of the wheelchair. To avoid the above situation and to consider the possible use of the treadmill with a sports wheelchair, the roller support frames 36, 36 may be designed to provide an angle of inclination up to 15 degrees.

The shafts 35, 35 on the rollers 34, 34 have timing pulleys 54, 54 fixed thereto, respectively. On each of the right and left sides of the platform 31, there are a flywheel 53 and its shaft 55 in parallel with the shaft 35 on the roller 34. A timing pulley 56 is fixed to the shaft 55 (FIGS. 8(*a*), 9(*a*)). The flywheel 53 has a load belt 58 around it, with the frictional surface of the load belt 58 being in contact with the flywheel 53. One end of the load belt 58 is secured to a spring bracket 59 fixed to the inner side of each of the right and left sides of the platform 31, and the other end of the load belt 58 is connected to one end of a traction rope 61 by way of a spring 60. The other end of the traction rope 61 is fixed to a bottom end of a part 62*a* of an L-shape adjusting lever 62. The corner of the adjusting lever 62 is rotatively connected to the inner side of each of the right and left sides of the platform by a pin 70, so that the lever 62 can swing pivotally about the pin 70. On a lateral part 62*b* of the adjusting lever 62, there is a load adjusting knob 63 having a threaded rod 63*a* whose bottom end is in contact with the lateral part 62*b* (FIG. 9(*b*)). The threaded rod 63*a* of the load adjusting knob 63 engages with a nut 64 mounted on the upper face of the platform 31. When the load adjusting knob 63 is rotated, the threaded rod 63*a* may be raised or lowered as indicated by arrow 65 or 66 (FIG. 9(*b*)).

Figure 9A:
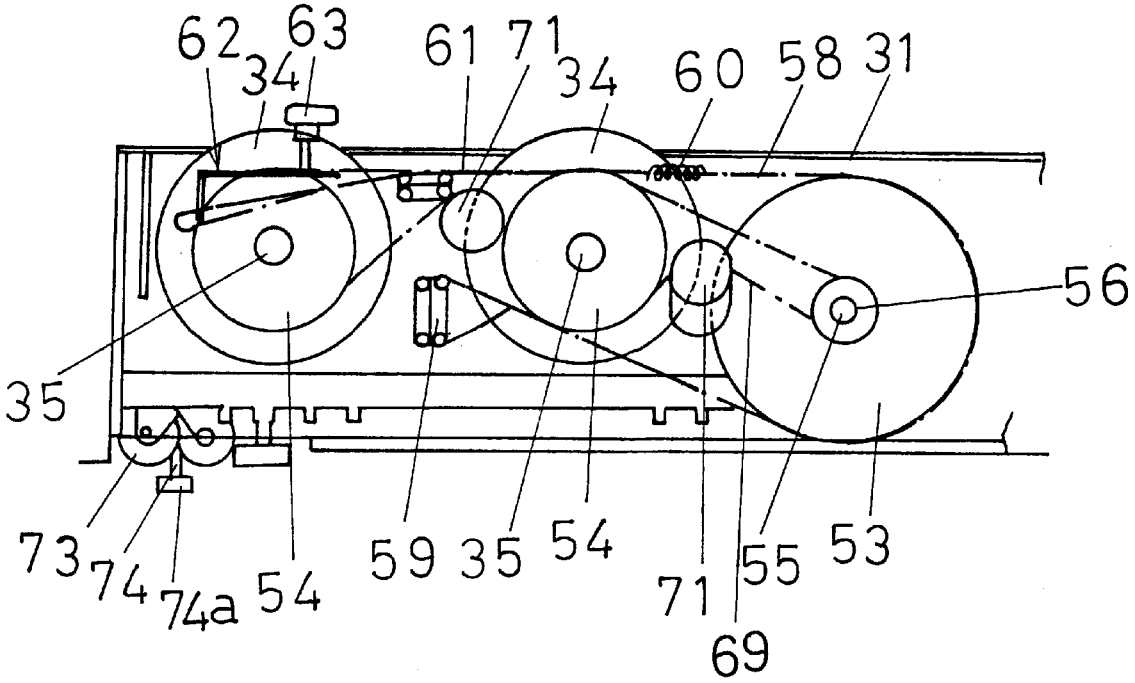
FIG. 9(*a*) is an enlarged front view illustrating how braking means may be operated for providing a resistance to be applied against the rotary motion of the rollers according to the embodiment of FIG. 5, with some non-essential parts or elements not shown.
Figure 9B:
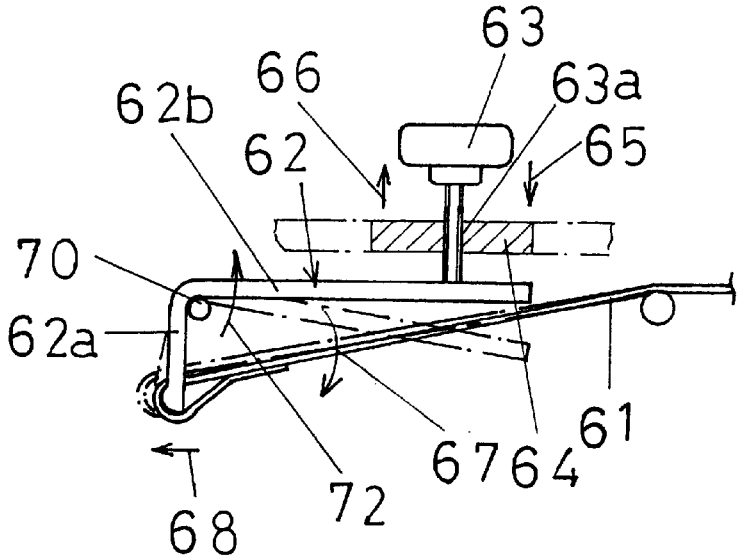

By referring to FIG. 9(*b*), in operation, when the load adjusting knob 63 is turned in the direction of lowering the threaded rod 63*a* as indicated by arrow 65, the lateral part 62*b* may be swung as indicated by arrow 67 to the position shown in dot-dash lines in FIG. 9(*b*), followed by the longitudinal part 62*a* moving as indicated by arrow 68 from the dot-dash line position to the position shown in solid lines in FIG. 9(*b*). This causes the load belt 50 to contact the flywheel 53 more strongly by means of the spring 60, thus increasing the frictional force accordingly. The resulting load to be applied against the rotary motion of the rollers 34, 34 may be accordingly increased. Conversely, when the load adjusting knob 63 is turned in the direction of raising the threaded rod 63*a* as indicated by arrow 66, the adjusting lever 62 is swung about the pin 70 in the direction of arrow 72. This action contracts the spring 60, which reduces its tension. The contact pressure of the load belt 58 upon the flywheel 53 may be decreased, and the resulting load to be applied against the rotary motion of the roller 34 may be accordingly reduced. As the timing belt 69 is threaded around the timing pulleys 54, 54, 56, the rotary motion of the rollers 34, 34 may be transmitted through the timing pulleys 54, 54, 56 and timing belt 69 to the flywheel 53 accurately. There is a guide pulley 71 for the timing belt 69 which may provide an adequate tension for the timing belt 69.

The position of the load adjusting knob 63 may be detected by a limit switch or the like which provides information on the current position of the load adjusting knob 63. This information may be helpful in knowing the current values of parameters such as the contact pressure of the load belt 58 upon the flywheel 53, the tension of the load belt 58, and the like, from which the current load being applied against the rotary motion of the rollers 34, 34 may be detected.

In the treadmill according to the embodiment described above, the platform 31 has casters 73, 73 and adjustable legs 74, 74 at four corners thereof. When the treadmill is to be moved, the adjustable legs 74, 74 may be raised by turning their respective support shafts to bring their respective support bases 74*a*, 74*a* away from the floor, thereby allowing the casters 73, 73 to contact the floor. When the treadmill is to be brought to rest, the adjustable legs 74, 74 may be lowered by turning the respective support shafts to bring the respective support bases 74*a*, 74*a* into contact with the floor, thereby allowing the casters 73, 73 to be raised away from the floor. The horizontal posture of the treadmill may then be adjusted so that it can stand with stability.

Figure 8A:
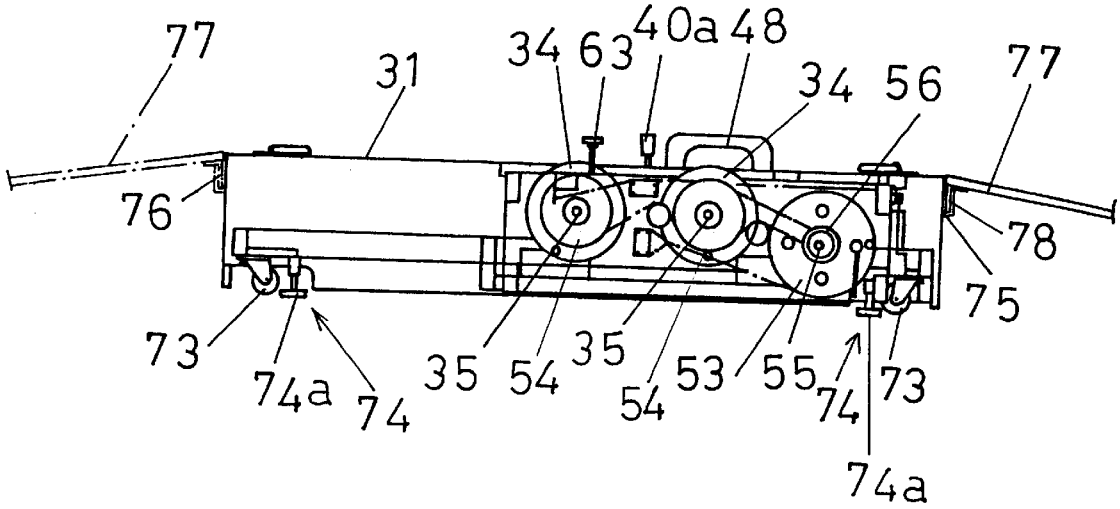
FIG. 8(*a*) is a front view illustrating how means for adjustably providing resistance to be applied against the rotary motion of the rollers may be controlled, and how a lift stand may be mounted according to the embodiment of FIG. 5, with some non-essential parts or elements not shown.
Figure 8B:
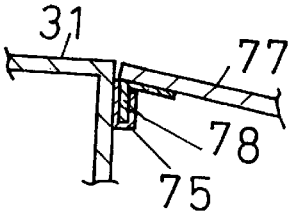

On each of the front and rear sides of the platform 31, there is an engaging bracket 75, 76 which is fixed to the respective edge of the front and rear sides (FIG. 8(*a*)). When the lift stand 77 is now placed in its highest position, an engaging member 78 on the bottom edge of the lift stand 77 may be made to engage the engaging groove on the corresponding bracket 75 or 76. Thus, the lift stand 77 may be coupled with the platform 31. More specifically, the engaging member 78 on the lift stand 77 may thereby be made to engage the engaging bracket 75 on the edge of the rear side of the platform 31 by inserting the former into the latter. The lift stand 77 may thereby be coupled with the platform 31 (FIGS. 8(*a*), 8(*b*)). In this state, the person on the wheelchair can advance onto the platform 31 from its rear side by using the lift stand 77 (FIG. 5). Similarly, the engaging member 78 on the lift stand 77 may be made to engage the engaging bracket 76 on the edge of the front side of the platform 31 by inserting the former into the latter. The lift stand 77 may thereby be coupled with the platform 31. In this state, the person on the wheelchair can advance onto the platform 31 from its front side by using the lift stand 77.

Referring back to FIGS. 5 and 6, on the front side of the platform 31, there are a guide frame 80 for engaging the front wheel 33*a* on the wheelchair 32, and a stopper 81 for engaging a foot rest 90 on the wheelchair 32, all of which are provided on the top of the platform 31. To ensure the stability of the wheelchair 32 on the platform 31, there is a fastening belt 82. At the upper right and left corners of the platform 31, there is a mounting hole for a display 79. This display 79 presents useful information, such as the current operational status of the treadmill that may include the magnitude of the load being applied against the roller motion of the rollers 34, 34, the angle of inclination of the rollers 34, 34, the number of rotations of the rollers 34, 34, and the like. Although not shown, such information may be provided by any sensors or detectors which are coupled to the appropriate electric or electronic circuit.

Figure 12:
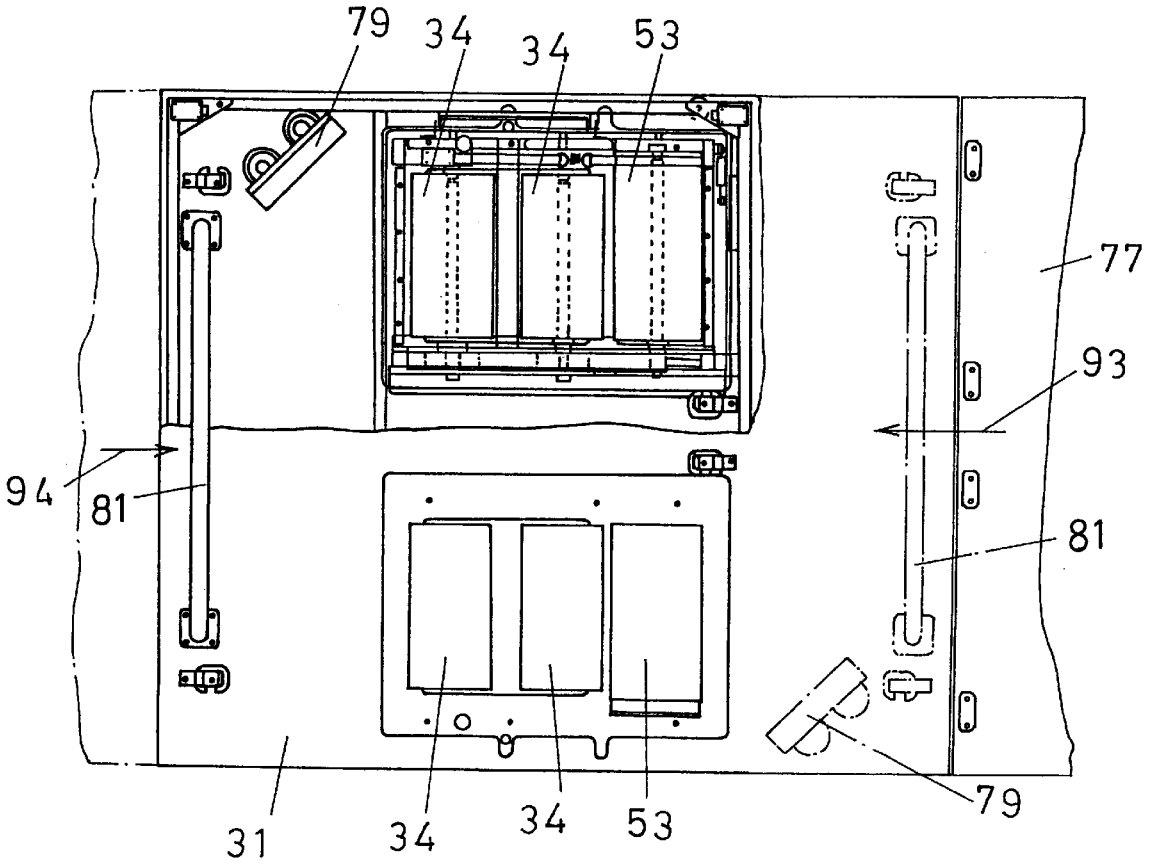
FIG. 12 is a plan view illustrating the internal construction of the treadmill according to a further preferred embodiment of the present invention, with some non-essential parts or elements not shown.

Referring now to FIG. 12, the stopper 81 and the display 79 may be provided either on the front or rear side of the platform 31 as shown by the dot-dash lines. In this way, the lift stand 77 may be mounted either on the front or rear side of the platform 31. In any case, as viewed from the side of the user 83 on the wheelchair 32, the stopper 81 and the display 79 may always be placed in front of the user 83.

Figure 10:
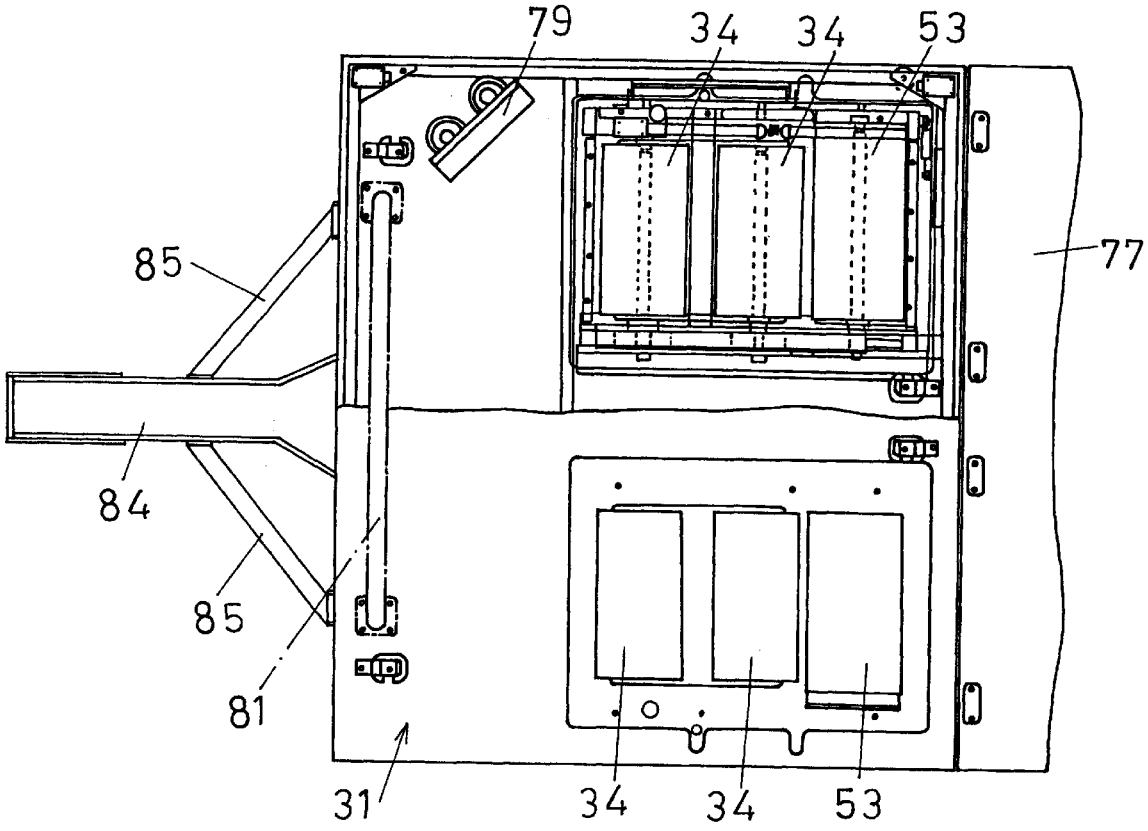
FIG. 10 is a plan view illustrating still another preferred embodiment of the present invention, with some parts or elements not shown and some portions shown as broken away.
Figure 11:
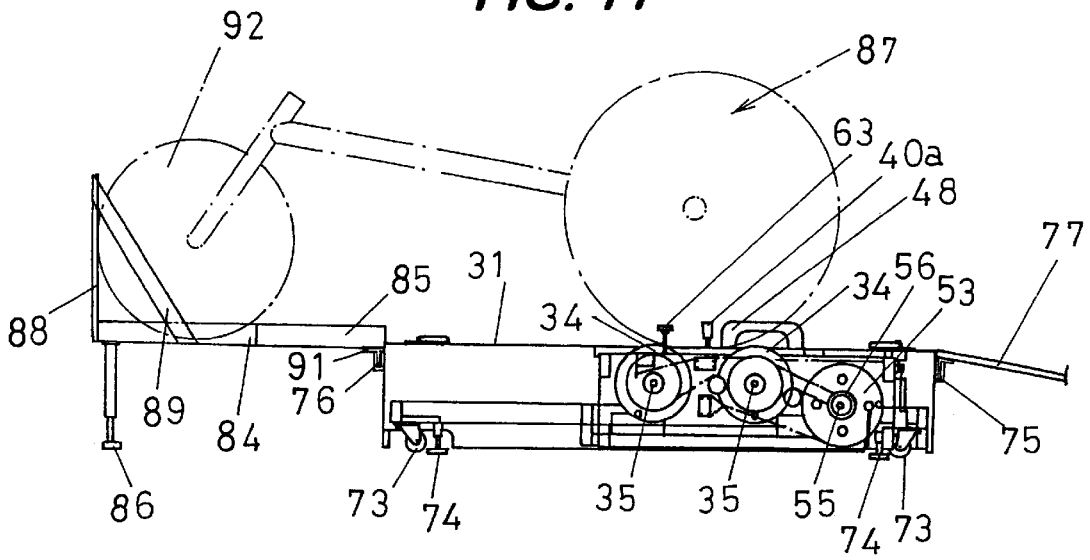
FIG. 11 is a front view of the embodiment of FIG. 10, with some non-essential parts or elements not shown and some portions shown as broken away.

The treadmill according to the present invention may be modified to accommodate any type of sports wheelchair and to allow the user to practice the training or any other exercises on such wheelchair, as described below. Specifically, on the front side of the platform 31, there is a support plate 84 extending outwardly from the front side including two support branches 85, 85 extending from the support plate 84. Each of the support branches 85, 85 has an engaging member 91 on the base end thereof, which is adapted to engage a corresponding bracket 76 on the platform 31 which may be used to engage the lift stand 77 (FIGS. 10, 11). There is a height adjustable leg 86 extending below the support plate 84 on its front side. This height adjustable leg 86 may be used to adjust the height of the front side of the support plate 84.

As readily understood from the above description, the support plate 84 may be used particularly when the treadmill is used to conduct the training exercises on a sports wheelchair. When the treadmill is used with any ordinary wheelchair other than a sports wheelchair, the support plate 84 may not have to be mounted. The support plate 84 serves as an aid to hold the front wheel 92 of the sports wheelchair fast. Thus, the present invention should not be limited to the arrangement specifically described above, but any arrangement that meets the above requirements may be employed. There are a stopper 88 for the front wheel 92 and a reinforced frame member 89 for the stopper 88 that prevent the front wheel from possibly slipping.

(Third Embodiment)

According to a third embodiment shown in FIG. 12, the stopper 81 and the display 79 may be mounted either on the front or rear side of the platform 31. Specifically, the treadmill according to this embodiment allows the person on the wheelchair to move up either on the front or rear side of the casing 31 and conduct the training exercise. Differently from the preceding embodiment shown in FIGS. 5 through 11, the roller support frame 36 is preferably mounted nearer to the center area of the platform 31.

In all of the embodiments, including the third embodiment, the roller support frame 36 may be mounted, removed and/or reoriented. In the embodiment shown in FIG. 5, the roller support frame 36 is mounted such that the flywheel 53 is placed on the front side of the platform 31. In the embodiments shown FIGS. 6 and 12, the roller support frame 36 is mounted such that the flywheel 53 is placed on the rear side of the platform 31. Any of the embodiments allows for mounting, removing and/or reorientation of the roller support frame, and therefore allows for the rollers 34, 34 being adapted to the positions of the corresponding side wheels, regardless of whether the wheelchair is moving up on the front or rear side of the platform 31.

Figure 13:
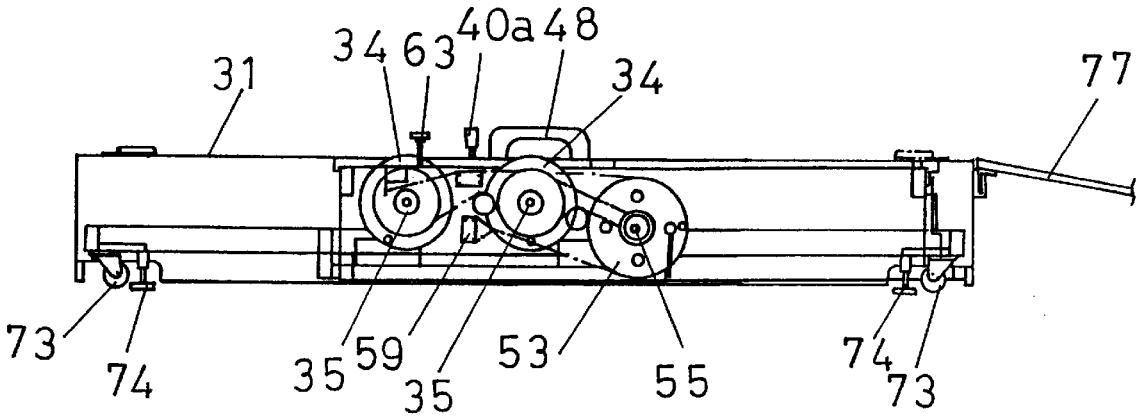
FIG. 13 is a front view illustrating the internal construction of the treadmill according to the embodiment of FIG. 12, with some non-essential parts or elements not shown.

In FIG. 12, when the wheelchair 32 is advancing onto the platform 31 from the side as indicated by arrow 93, the lift stand 77 may be mounted on the side shown in FIG. 13 and also as shown by the solid line in FIG. 12, and the stopper 81 and the display 79 may be mounted in the positions as shown by the respective solid lines. When the wheelchair 32 is advancing onto the platform 31 from the side as indicated by arrow 94, the lift stand 77 may be mounted on the side shown by dot-dash lines in FIG. 12, and the stopper 81 and the display 79 may be mounted in the positions as shown by respective dot-dash lines in FIG. 12. In these embodiments, two circuits for the display 79 are required.

Although the present invention has been described by referring to the particular preferred embodiments thereof, it should be understood that various changes and modifications may be made without departing from the spirit and scope of the invention as defined in the appended claims.

What is claimed is:

1. A treadmill for use with a wheelchair, comprising:

a treadmill body comprising a casing;

two sets of rollers, each of said sets of rollers including two parallel rollers, mounted in said casing for supporting wheelchair side wheels thereon;

means disposed within said casing for adjusting an angle of inclination of said sets of rollers;

means disposed within said casing and operatively connected to one of said rollers in each of said sets of rollers for applying a resistance against rotary motion of said sets of rollers;

an auxiliary casing adapted to be coupled to one side of said casing for aiding a person on the wheelchair to advance the wheelchair onto said casing;

a guide casing comprising a movable means for guiding wheelchair wheels adapted to be coupled to an other side of said casing;

control means for controlling said means for adjusting an angle of inclination of said sets of rollers, said means for applying a resistance against rotary motion of said sets of rollers and movement of said means for guiding wheelchair wheels;

wherein said two sets of rollers are mounted in respective roller support frames, said roller support frames having respective pivot shafts extending transversely of said casing on opposite center sides of said roller support frames such that said roller support frames are pivotally swingable about said respective pivot shafts; and wherein said means for adjusting an angle of inclination of said sets of rollers comprises means for pivoting said roller support frames about said respective pivot shafts.

2. The treadmill of claim 1, wherein said means for applying a resistance against rotary motion of said sets of rollers comprises means for electrically or mechanically varying rotary motion of an output shaft and selectively coupling said output shaft to a shaft of at least one of said rollers in each of said sets of rollers.

3. The treadmill of claim 1, wherein said movable means for guiding wheelchair wheels comprises two guide members that extend vertically from said guide casing and are each adapted to be fitted in position on a front side of respective wheelchair wheels, means for adjusting the distance between said two guide members, and means for moving said guide casing closer to and away from said casing.

4. A treadmill for use with a wheelchair, comprising:

a treadmill body comprising a platform;

parallel rollers mounted in said platform at positions corresponding to wheelchair wheel positions for supporting wheelchair wheels;

means disposed within said platform for pivotally tilting said parallel rollers;

braking means disposed within said platform for applying a resistance against rotary motion of said rollers;

display means disposed on said platform for displaying current treadmill operation status information;

wherein said rollers are mounted in respective roller support frames, said roller support frames having respective pivot support rods extending transversely of said platform on opposite center sides of said roller support frames such that said roller support frames are pivotally swingable about said respective pivot support rods; and wherein said means for pivotally tilting said parallel rollers comprises means for engaging a side of each of said roller support frames opposite to said center side thereof with a lateral wall of said platform at a variable and adjustable height.

5. The treadmill of claim 4, wherein said means for engaging comprises a plurality of steps on said side of each of said roller support frames opposite to said center side thereof and a rod on said lateral wall of said platform adapted to disengageably engage any one of said plurality of steps.

6. The treadmill of claim 5, wherein said roller support frames are attachably, removably or reorientably mounted on said platform.

7. The treadmill of claim 4, wherein said roller support frames are attachably, removably or reorientably mounted on said platform.

8. The treadmill of claim 4, wherein said rollers each have a roller shaft and said braking means comprises:

a flywheel;

a flywheel shaft parallel with said roller shaft;

timing pulleys fixed to said roller shaft and said flywheel shaft;

a timing belt threaded around said timing pulleys;

a load belt threaded around an outer periphery of said flywheel; and means for controlling the contact pressure of said load belt against the outer periphery of said flywheel.

9. The treadmill of claim 4, wherein said rollers each have a roller shaft and said braking means comprises:

a flywheel;

a flywheel shaft parallel with said roller shaft;

timing pulleys fixed to said roller shaft and said flywheel shaft;

a timing belt threaded around said timing pulleys;

a load belt threaded around said flywheel; and means for controlling the tension of said load belt.

10. The treadmill of claim 4, and further comprising:

a lift stand; and means for engaging said lift stand provided on an edge of said platform on one side of said platform that is parallel with said rollers and on an edge of said platform on the other side of said platform opposite to the one side so that said lift stand can engage said engaging means on said edge on the one side or said edge on the other side of said platform.

11. The treadmill of claim 10, wherein said lift stand is engaged with said means for engaging said lift stand on one of said edge on the one side and said edge on the other side of said platform, and further comprising a support plate fixed to the other of said edge on the one side and said edge on the other side of said platform so as to be able to support a front wheel of a sports wheelchair.

12. The treadmill of claim 4, and further comprising a stopper on said platform adapted to engage a foot rest on the front side of a wheelchair, wherein said stopper and said display means are detachably attached to one of front and rear sides of said platform.

* * * * *